US008079460B2

(12) United States Patent
Kurz et al.

(10) Patent No.: US 8,079,460 B2
(45) Date of Patent: Dec. 20, 2011

(54) RECEPTACLE ASSEMBLY FOR TRANSPORTING MULTI-SIZE BEVERAGE CONTAINERS

(75) Inventors: Michael Kurz, Muhlhausen (DE); Hans-Peter Wild, Eppelheim (DE)

(73) Assignee: INDAG Gesellschaft für Industriebedarf mbH & Co. Betriebs KG, Eppelheim (DE)

( * ) Notice: Subject to any disclaimer, the term of this patent is extended or adjusted under 35 U.S.C. 154(b) by 434 days.

(21) Appl. No.: 12/433,694

(22) Filed: Apr. 30, 2009

(65) Prior Publication Data

US 2009/0274538 A1 Nov. 5, 2009

(30) Foreign Application Priority Data

May 2, 2008 (EP) ..... 08008367

(51) Int. Cl.
*B67C 3/00* (2006.01)

(52) U.S. Cl. ..... 198/473.1; 198/867.08; 198/803.11

(58) Field of Classification Search ..... 198/473.1, 198/867.08, 803.11, 468.2, 470.1, 867.02, 198/803.3; 141/165, 166
See application file for complete search history.

(56) References Cited

U.S. PATENT DOCUMENTS

| | | | | | |
|---|---|---|---|---|---|
| 3,090,478 | A * | 5/1963 | Stanley | 248/128 |
| 3,288,271 | A * | 11/1966 | Burford | 198/803.11 |
| 3,612,254 | A * | 10/1971 | Wideman | 198/802 |
| 4,159,762 | A * | 7/1979 | Bulwith | 198/867.07 |
| 4,787,505 | A * | 11/1988 | Tweedy | 198/867.08 |
| 5,224,586 | A * | 7/1993 | Naka et al. | 198/803.11 |
| 6,176,369 | B1 * | 1/2001 | Petrovic | 198/867.11 |
| 6,971,506 | B2 * | 12/2005 | Hassinen et al. | 198/803.14 |
| 7,055,676 | B2 * | 6/2006 | Hartness et al. | 198/803.7 |
| 7,572,123 | B2 * | 8/2009 | Barker et al. | 425/392 |
| 7,980,380 | B2 * | 7/2011 | Thielmann | 198/377.01 |
| 2007/0267096 | A1 | 11/2007 | Uriel | |

FOREIGN PATENT DOCUMENTS

| | | |
|---|---|---|
| EP | 0273798 | 6/1988 |
| EP | 1167210 | 2/2002 |
| WO | WO 03091109 | 6/2003 |

OTHER PUBLICATIONS

European Search Report corresponding to European Application No. EP 08 00 8367.8.

* cited by examiner

*Primary Examiner* — Mark A Deuble
(74) *Attorney, Agent, or Firm* — Stroock & Stroock & Lavan LLP

(57) ABSTRACT

A receptacle assembly for receiving and holding in place flexible containers in the upright position while the flexible containers are being transported on a conveyor. The receptacle assembly includes a guide supporting two supports, an adjustment mechanism, and a plurality of transport receptacles. Each transport receptacle includes two side supports, each of which are mounted on one of the supports. The supports are capable of being selectively displaced with respect to each other by operation of the adjustment mechanism, which allows the transport receptacle to be adjusted to receive and hold flexible containers of various sizes and configurations.

15 Claims, 4 Drawing Sheets

RECEPTACLE ASSEMBLY FOR TRANSPORTING MULTI-SIZE BEVERAGE CONTAINERS

FIELD OF THE INVENTION

The present invention relates generally to a receptacle assembly capable of being conveyed on a conveyor belt for handling flexible containers and in particular to an adjustment mechanism that permits flexible containers of various sizes to be held in place and transported on a conveyor.

BACKGROUND OF THE INVENTION

Flexible containers made of flexible foil blanks welded together at the sides have been used for holding beverages. For hygienic reasons and to sterilize the flexible containers, the flexible containers are preferably filled with a beverage in a hot state and cooled prior to further processing. To cool the beverage, the flexible containers are fixed in an upright position by a transport receptacle and transported through a cooling device. During this phase of processing, it is important that the flexible containers be maintained in the upright position. However, because different sizes of flexible containers are used to hold beverages, the transport receptacles must be adaptable to fit flexible containers of various sizes. Accordingly, a receptacle assembly that provides for the ability to secure in place and convey flexible containers of various sizes during cooling would be desirable.

SUMMARY OF THE INVENTION

Generally speaking in accordance with the invention, a receptacle assembly for selectively handling flexible containers of various sizes is provided. The receptacle assembly includes a first support, a second support, at least two first side supports, at least two second side supports, and an adjustment mechanism. The first support is constructed and arranged to define at least two first openings and the second support is constructed and arranged so that the first support and the second support are displaceable with respect each other. The first side supports are mounted, substantially upright, on the first support. The second side supports are each associated with one of the first side supports and each second side support extends through the first opening and is mounted, substantially upright, on the second support. Each second side support is spaced apart from its associated first side support to define a transport receptacle. The adjustment mechanism is capable of selectively positioning the first support with respect to the second support so as to permit displacement of the first side support and the second side support to accommodate and hold the flexible containers of various sizes during transport on a conveyor.

Accordingly, it is an object of this invention to provide a receptacle assembly that allows for the accommodation of flexible containers of different dimensions by altering the distance between the first side support and the second side support so that flexible containers of various sizes may be held securely in an upright position while being transported on a conveyor.

It is a further object of the instant invention to provide a plurality of transport receptacles capable of being adjusted jointly on a common conveyor in order to efficiently alter the distance between the first side support and the second side support to accommodate flexible containers of various sizes.

It is still a further object of the instant invention to provide first side supports and second side supports that may be selectively contoured to various flexible container sizes so as to provide optimum support for flexible containers of various sizes. In one embodiment, this may be achieved by providing a plurality of staggered bearing surfaces for the flexible containers on at least one and/or both of the side supports. The staggered bearing surfaces will allow the flexible containers to be secured by at least two bearing surfaces that are contoured to fit various sizes and configurations of flexible containers.

It is still a further object of the instant invention to provide an insertion aid to facilitate the insertion of the flexible containers into a transport receptacle. In one embodiment, the insertion aid include, at least one inlet edge, which extends toward the interior of the transport receptacle in a funnel-shaped manner to facilitate the placement of the flexible foil bags into the transport receptacle. In another embodiment, the first side support and second side support are constructed and arranged so that they are inclined outward, away from one another, to assist in receiving and centering the flexible foil bags.

It is still a further object of the instant invention to provide an adjustment mechanism to selectively adjust the supports. In one embodiment, the adjustment mechanism is disposed on the first support and is capable of engaging a pinion. The adjustment mechanism also includes a gripping surface provided on at least the first support or the second support to better allow the side supports to be selectively adjusted.

Additional features and advantages of the present invention are described further below. This summary section is meant merely to illustrate certain features of the invention. It is not meant to limit the scope of the invention in any way. The failure to discuss a specific feature or embodiment of the invention or the inclusion of one or more features in this summary section, should not be construed to limit the invention as claimed.

BRIEF DESCRIPTION OF THE DRAWINGS

The foregoing summary, as well as the following detailed description of the preferred embodiments of the application, will be better understood when read in conjunction with the appended drawings. For the purpose of illustrating the device of the present application there is shown in the drawings preferred embodiments. It should be understood, however, that the application is not limited to the precise arrangements and instrumentalities shown. In the drawings.

DETAILED DESCRIPTION OF THE PREFERRED EMBODIMENTS

Figure 1:
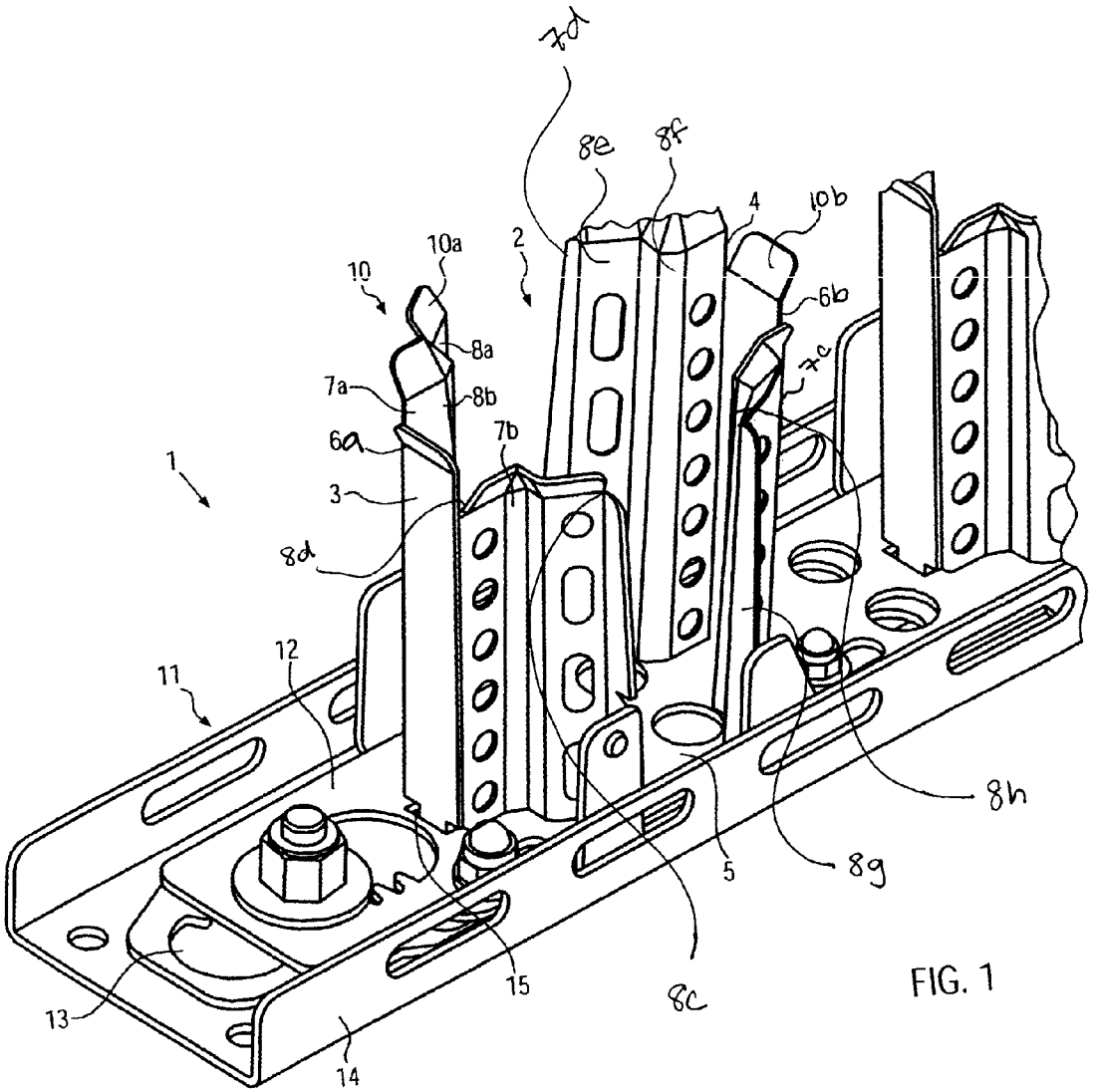
FIG. 1 shows a perspective view of the receptacle assembly in accordance with a preferred embodiment of the instant invention.
Figure 2:
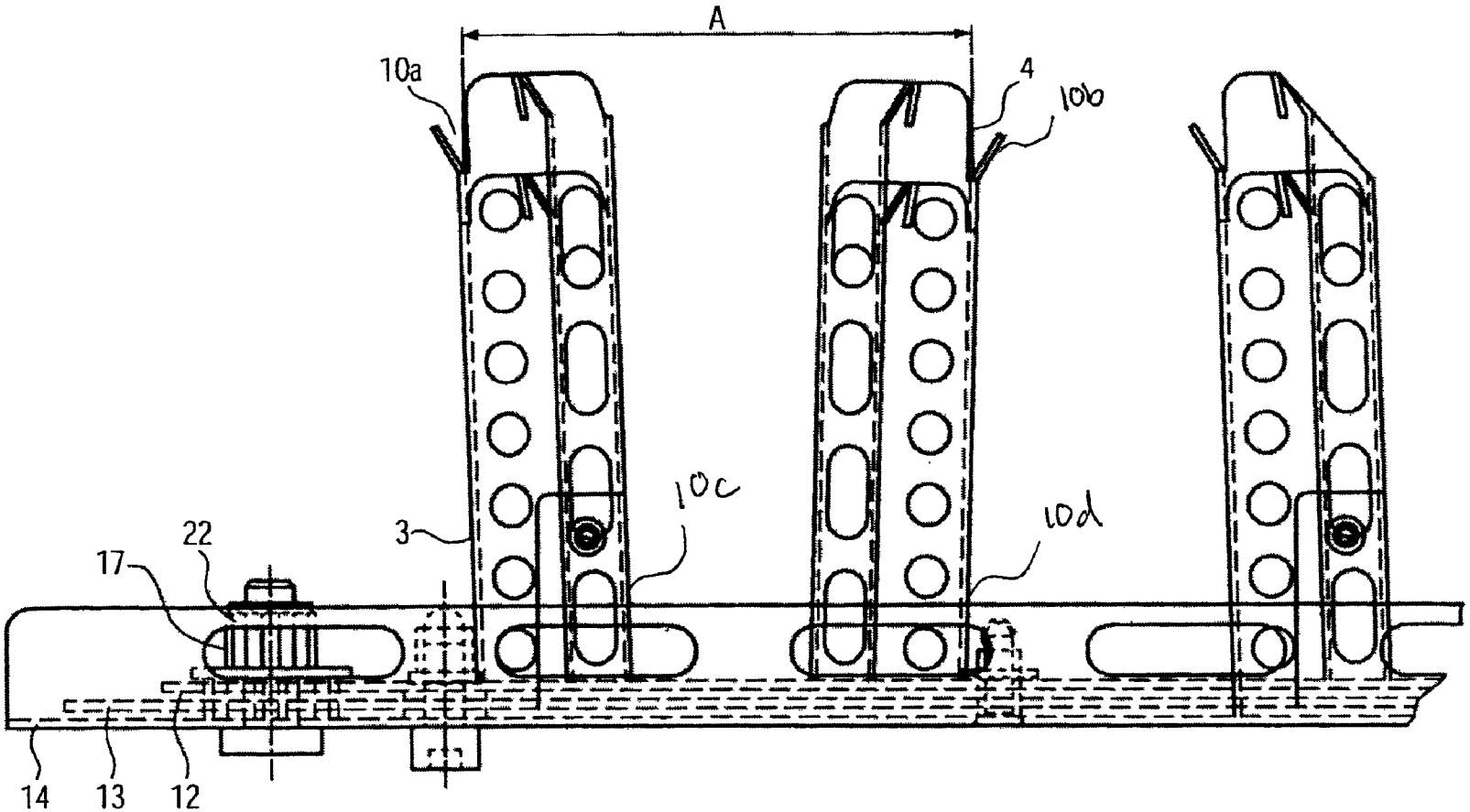
FIG. 2 shows a lateral view of the receptacle assembly depicted in FIG. 1.
Figure 3:
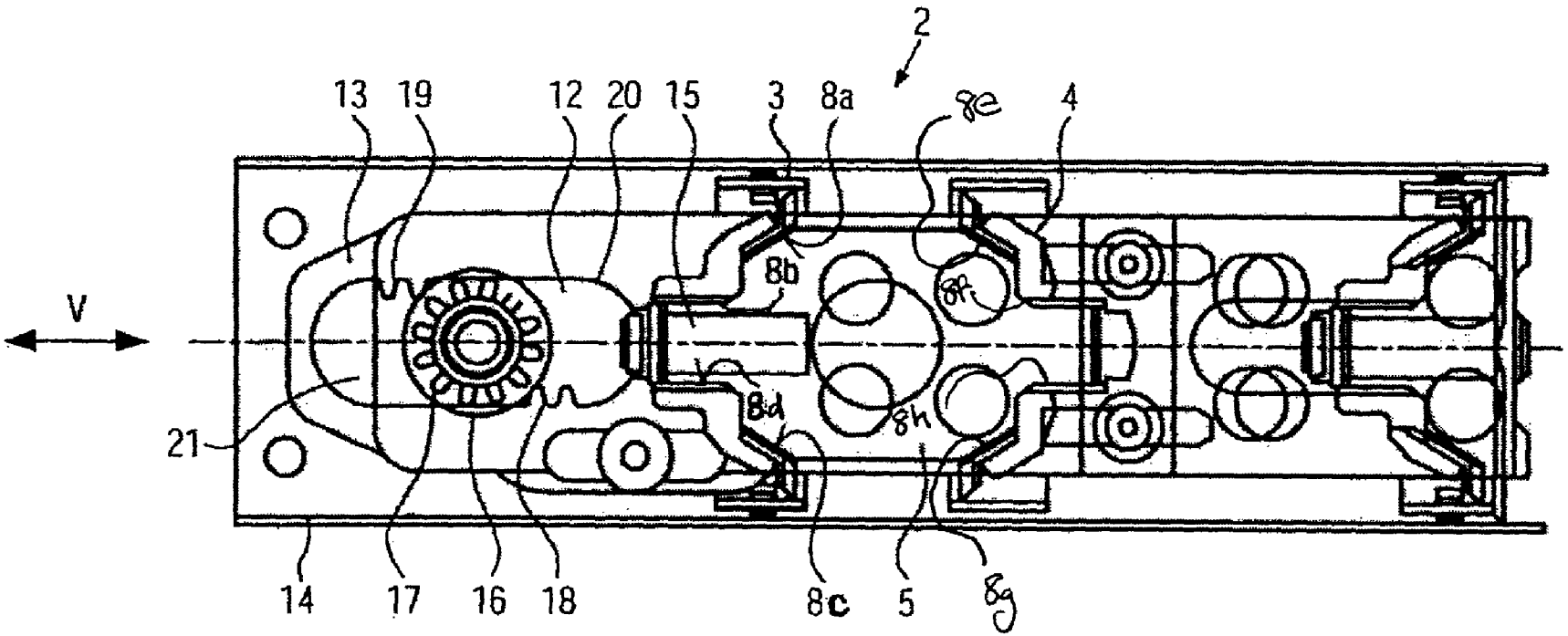
FIG. 3 shows a top view of the receptacle assembly depicted in FIG. 1.
Figure 4:
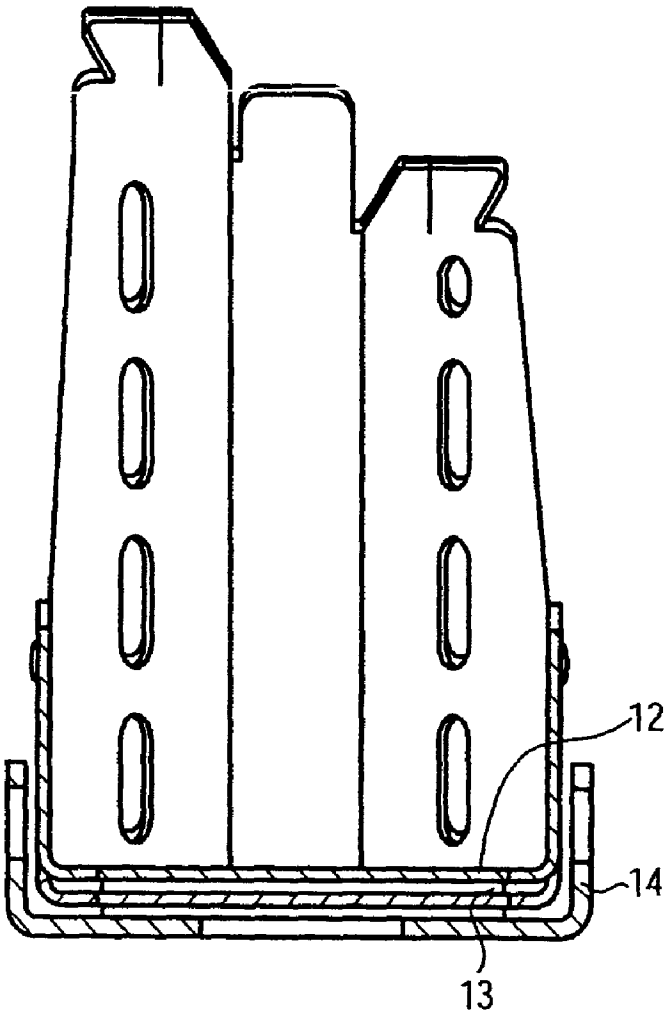
FIG. 4 is a sectional view of the receptacle assembly of FIG. 1, depicting the front face of the transport receptacle.

Reference is first made to FIGS. 1, 2, and 3 wherein a detailed arrangement of the operative components of an exemplary embodiment of a receptacle assembly, generally indicated at 1, for handling flexible containers in accordance with the instant invention is depicted. In the exemplary embodiment, the flexible containers are flexible foil bags (not shown) of the type used for beverages or the like which are produced from foil blanks the edges of which are welded together to create a flexible foil bag. The foil bags may also be provided with a base stand as needed. After the bag is filled with a beverage, it is transported in an upright, preferably standing, position with the seam opposite the base of the foil bag remaining open. In the exemplary embodiment depicted in FIGS. 1, 2, and 3, the receptacle assembly 1 is designed to hold the foil bags filled with a beverage in an upright position to be conveyed on a conveyor (not shown) through a cooling device (not shown).

In order to have an understanding of the instant invention, reference is made to the embodiment shown in FIGS. 1, 2, and 3 wherein the receptacle assembly 1 includes a guide 14 having a U-shaped cross section that is placed on a conveyor and that supports a first support 12, a second support 13, and adjustment mechanism, generally indicated at 11. A plurality of transport receptacles, generally indicated at 2, that are of identical design and arranged in a row, are supported by one elongated first support 12 and elongated second support 13 so that the plurality of transport receptacles 2 can be selectively simultaneously adjusted to a new distance A by operation of the adjustment mechanism 11 in a manner to be described in greater detail below.

First support 12 and second support 13 may be constructed of elongated-shaped sheet-metal elements and arranged on the guide 14 to rest on each other surface to surface. The first support 12 may simultaneously serve as the bottom 5 and is constructed to define at least two or more first openings 15 depending upon the number of transport receptacles 2 to be provided. The second support 13 is located beneath the first support 12. Each first side support 3 is mounted on the first support 12 and each second side support 4 extends through one of the first openings 15 in the first support 12 and is mounted on second support 13. The first support 12 and the second support 13 are capable of being displaced by an adjustment mechanism 11, which allows the distance A to be selectively altered.

The transport receptacles 2 are designed and constructed to receive the foil bags and hold the foil bags in place in a standing position. Each transport receptacle 2 comprises a first side support 3 and a second side support 4, which are identical in shape and are constructed and arranged to mirror each other. Each first side support 3 and each second side support 4 are spaced apart at a distance A (FIG. 2) between them. Distance A corresponds to the size of the foil bags to be received and held by the transport receptacle.

As depicted in FIGS. 1, 2, and 3, the first side support 3 and the second side support 4 extends upward from a bottom 5 of the transport receptacle 2 and may be constructed of sheet-metal and provided with perforations or openings to reduce the weight. Each first side support 3 includes a first central surface 6*a* and a first left wing surface 7*a* and first right wing surface 7*b* projecting from the vertical edge of each side of the first central surface 6*a*. The first left wing surface 7*a* and first right wing surface 7*b* extends outwardly at an angle so that the distance between the first left wing surface 7*a* and first right wing surface 7*b* becomes larger as the distance from the first central surface 6*a* increases. Each second side support 4 is identical to each first side support 3 and, thus, includes a second central surface 6*b* and a second left wing surface 7*c* and second right wing surface 7*d* projecting from the vertical edge of each side of the second central surface 6*b*. The second left wing surface 7*c* and second right wing surface 7*d* are angled outwardly such that the distance between the second left wing surface 7*c* and second right wing surface 7*d* becomes larger as the distance from the first central surface 6*b* increases.

The first side support 3 and the second side support 4 are constructed and arranged to have U-shaped cross sections. The first side support 3 and the second side support 4 support the foil bag at opposite side portions of the foil bag, preferably in the area of the lateral seams, so as to bear against the front and rear sides of the foil bag to support the foil bag in such a manner that even a foil bag without a base stand, or a foil bag with a base stand, is secured in the upright position in the transport receptacle 2 to prevent any shifting or changing of the position of the foil bag to permit the foil bags to be conveyed at increased speeds. The first side support 3 and the second side support 4 may also have openings or perforations so that cooling of the beverage is not, or not more than necessary, prevented or delayed.

The first central surface 6*a*, first left wing surface 7*a*, and first right wing surface 7*b* may include a plurality of first bearing surfaces 8*a*, 8*b*, 8*c*, 8*d*. The second central surface 6*b*, second left wing surface 7*c*, and second right wing surface 7*d* may include a plurality of second bearing surfaces 8*e*, 8*f*, 8*g*, 8*h*. As shown in FIG. 3, the first bearing surfaces 8*a*, 8*b*, 8*c*, 8*d* of the first side support 3 mirror the second bearing surfaces 8*e*, 8*f*, 8*g*, 8*h* of the second side support 4 over the width thereof. For instance, with reference to FIG. 3, each first bearing surfaces 8*a*, 8*b* mirrors first bearings surfaces 8*c*, 8*d* and corresponds to second bearing surfaces 8*e*, 8*f*, which mirrors second bearing surfaces 8*h*, 8*g*. Each first bearing surface 8*a*, 8*b*, 8*c*, 8*d* and each second bearing surface 8*e*, 8*f*, 8*g*, 8*h* is constructed and arranged to optimally support a specific foil bag configuration by bearing against it over the entire surface. The arrangement of the first bearing surfaces 8*a*, 8*b*, 8*c*, 8*d* and second bearing surfaces 8*e*, 8*f*, 8*g*, 8*h*, the distances between each first bearing surface 8*a* and 8*b*, and 8*c* and 8*d*, found on the first side support 3, the distances between each second bearing surface 8*e* and 8*f*, and 8*g* and 8*h*, found on the second side support 4, and the distance between the first bearing surfaces 8*a*, 8*b* on the first side support 3 and the second bearing surfaces 8*e*, 8*f* on the second side support 4 and the distance between first bearing surfaces 8*c*, 8*d* and the second bearing surfaces 8*g*, 8*h*, are preferably adaptable to foil bags having different dimensions and configurations, and thus may be arranged in a variable step configuration. The first bearing surfaces 8*a*, 8*b*, 8*c*, 8*d* and second bearing surfaces 8*e*, 8*f*, 8*g*, 8*h* may also provide for a continuous surface without any steps.

Each transport receptacle 2 is further provided with an insertion aid, generally indicated at 10. In the embodiment shown in FIG. 1, the insertion aid includes a first upper portion 10*a* of the first side support 3 and a second upper portion 10*b* of the second side support 4. In an exemplary embodiment, each first upper portion 10*a* and the second upper portion 10*b* may be bent outward, away from the interior of the transport receptacle 2. Thus, the introduction opening of the transport receptacle 2, which is opposite the bottom 5, tapers downward, creating a funnel shape, so that foil bags introduced into the transport receptacle 2 are centered.

Insertion aid 10 may also include positioning the first side support 3 and second side support 4 substantially upright, at an upward and outward inclination, away from each other, such that the interior surface of the first side support 3 and the bottom 5 form an angle greater than 90 degrees on the interior surface of the transport receptacle and the interior surface of the second side support 4 and bottom 5 form an angle greater than 90 degrees on the interior surface of the transport receptacle. As a result, the distance between the upper portion 10*a* of the first side support 3 and the upper portion 10*b* of the second side support 4 is greater than the distance between the lower portion 10*c* (FIG. 2) of the first side support 3 and the lower portion 10*d* (FIG. 2) of the second side support 4. This positioning of the first side support 3 and the second side support 4 also facilitates placement of the foil bags into the transport receptacles 2 and centering the foil bags.

In accordance with the embodiment shown in FIG. 1, the adjustment mechanism 11 includes the first support 12 and the second support 13, which are arranged in the guide 14, such that the first support 12 and the second support 13 are displaceable relative to each other in the direction of the double arrow V. The first openings 15, as depicted in FIG. 3, are of sufficient length to permit such displacement of the first support 12 and second support 13 so that the distance A may be selectively varied in order for the transport receptacle 2 to accommodate foil bags of various sizes and configurations.

The adjustment mechanism 11 further includes an actuating device 16, which, in accordance with one preferred embodiment, includes a pinion 17, a first gripping surface 18 and a second gripping surface 19 for permitting adjustment in the V direction depicted in FIG. 3. The first gripping surface 18 and second gripping surface 19 may be indents, or in an exemplary embodiment, rows of teeth. The first gripping surface 18 is disposed on a limiting edge of a first adjustment opening 20 defined by the first support 12 and the second gripping surface 19 is disposed on the opposite limiting edge of a second adjustment opening 21 defined by the second support 13. The actuating device 16 may also only include either the first gripping surface 18 disposed on a limiting edge of the first adjustment opening 20 or the second gripping surface 19 disposed on a limiting edge of the second adjustment opening 21. However, the inclusion of both the first gripping surface 18 and the second gripping surface 19 permits finer adjustment steps. The pinion 17 is rotatably mounted on the guide 14 and is selectively capable of engaging the first gripping surface 18 and the second gripping surface 19 simultaneously on diametrically opposite sides so that the first support 12 and the second support 13 are displaced relative to each other in mutually opposite direction along the double arrow V when the pinion 17 is rotated in the direction of double arrow D. The rotation of the pinion 17 may be accomplished manually or automatically. The adjustment mechanism 11 may also include a fixing mechanism 22, which can be used to fix the transport receptacle 2 in place once the first support 12 and second support 13 have been displaced to achieve the desired distance A.

While there have been shown and described fundamental novel features of the invention as applied to the preferred and exemplary embodiments thereof, it will be understood that the omissions and substitutions and changes in the form and details of the disclosed invention may be made by those skilled in the arts without departing from the spirit of the invention. Moreover, as is readily apparent, numerous modifications and changes may readily occur to those skilled in the art. Hence, it is not desired to limit the invention to the exact construction and operation shown and described, and, accordingly all suitable modification equivalents may be resorted to falling within the scope of the invention as claimed. It is the intention, therefore, to be limited as only as indicated to the scope of the claims appended hereto.

What is claimed is:

1. A receptacle assembly capable of being conveyed on a conveyor belt for handling flexible containers of various sizes comprising:

a first support constructed and arranged to define at least two first openings and a second support constructed and arranged to be displaceable with respect to the first support;

at least two first side supports, which are substantially upright and mounted to the first support;

at least two second side supports, which are substantially upright, each second side support being associated with one of the first side supports and each second side support extending through the first opening and mounted to the second support and spaced apart from the associated first side support to define a transport receptacle; and an adjustment mechanism capable of selectively positioning the first support with respect to the second support so as to permit displacement of the first side support and the second side support to accommodate flexible containers of various sizes.

2. The receptacle assembly of claim 1 further comprising:

a guide supporting the first support, second support, and the adjustment mechanism.

3. The receptacle assembly of claim 1 wherein the second support is located underneath the first support.

4. The receptacle assembly of claim 1 wherein the first side support includes one or more perforations and the second side support includes one or more second perforations.

5. The receptacle assembly of claim 1, wherein the first side support and the second side support are constructed of metal.

6. The receptacle assembly of claim 1, wherein, each first side support is a web which includes:

a first central surface;

a first right wing surface and a first left wing surface projecting from the first central surface defining one or more first bearing surfaces constructed and arranged to optimally support the flexible containers;

each second side support having:

a second central surface; and a second right wing surface and a second left wing surface projecting from the second central surface defining one or more second bearing surfaces constructed and arranged to optimally support the flexible containers.

7. The receptacle assembly of claim 1 wherein the first side support includes a U-shaped cross section and the second side support includes a U-shaped cross section.

8. The receptacle assembly of claim 2 further comprising:

an insertion aid, wherein the insertion aid includes a first upper portion of each first side support, wherein the first upper portion is bent away from the second side support and a second upper portion of the each second side support, wherein the second upper portion is bent away from the first side support, so as to center the flexible containers when they are received into the one or more transport receptacles.

9. The receptacle assembly of claim 1 wherein each first side support has a first lower portion and a first upper portion and each second side support has a second lower portion, and a second upper portion; and providing that the first upper portion and the second upper portion define a upper distance and the first lower portion and the second lower portion define a lower distance, wherein the upper distance is greater than the lower distance.

10. The receptacle assembly of claim 1 wherein the adjustment mechanism includes:

a first adjustment opening defined by the first support;

a second adjustment opening defined by the second support;

a first gripping surface disposed on the first adjustment opening;

a second gripping surface disposed on the first adjustment opening; and a gear element capable of simultaneously engaging the first gripping surface and the second gripping surface to displace the first side support relative to the second side support.

11. The receptacle assembly of claim 1 wherein the adjustment mechanism includes:

a locking mechanism associated with the first support and second support for selectively locking the position of the first side support and the second side support with respect to each other.

12. The receptacle assembly of claim 10 wherein each first gripping surface comprises a first row of teeth.

13. The receptacle assembly of claim 10 wherein each second gripping surface comprises a second row of teeth.

14. The receptacle assembly of claim 12 wherein each second gripping surface comprises a second row of teeth.

15. The receptacle assembly of claim 10 wherein the gear element is a pinion.

* * * * *